US009082531B2

(12) United States Patent
Caveney

(10) Patent No.: US 9,082,531 B2
(45) Date of Patent: Jul. 14, 2015

(54) METHOD FOR FORMING AN ENHANCED COMMUNICATION CABLE

(75) Inventor: Jack E. Caveney, North Palm Beach, FL (US)

(73) Assignee: Panduit Corp., Tinley Park, IL (US)

( * ) Notice: Subject to any disclaimer, the term of this patent is extended or adjusted under 35 U.S.C. 154(b) by 1126 days.

(21) Appl. No.: 13/087,142

(22) Filed: Apr. 14, 2011

(65) Prior Publication Data

US 2011/0192022 A1 Aug. 11, 2011

Related U.S. Application Data

(63) Continuation of application No. 11/735,132, filed on Apr. 13, 2007, now Pat. No. 7,946,031, which is a continuation of application No. 11/353,885, filed on Feb. 14, 2006, now Pat. No. 7,205,479.

(60) Provisional application No. 60/653,286, filed on Feb. 14, 2005.

(51) Int. Cl.

| | |
|---|---|
| ***H01R 43/00*** | (2006.01) |
| ***H01B 11/06*** | (2006.01) |
| ***H01B 11/04*** | (2006.01) |

(Continued)

(52) U.S. Cl.

CPC ..... *H01B 11/06* (2013.01); *H01B 11/04* (2013.01); *H01B 13/143* (2013.01); *H01B 11/002* (2013.01); *Y10T 29/49117* (2015.01); *Y10T 29/49123* (2015.01); *Y10T 29/5187* (2015.01)

(58) Field of Classification Search

CPC .... H01B 13/143; H01B 11/04; H01B 11/002; H01B 11/06; Y10T 29/49117; Y10T 29/5187; Y10T 29/49123

USPC ..... 29/33 F, 825; 174/113 R, 113 C, 113 AS, 174/110 R

See application file for complete search history.

(56) References Cited

U.S. PATENT DOCUMENTS

| | | | |
|---|---|---|---|
| 476,484 | A | 6/1892 | Patterson |
| 527,414 | A | 10/1894 | Dewees |
| 630,697 | A | 8/1899 | Highfield et al. |

(Continued)

FOREIGN PATENT DOCUMENTS

| | | | |
|---|---|---|---|
| DE | 1704718 | A | 7/1971 |
| GB | 804560 | A | 11/1958 |

(Continued)

OTHER PUBLICATIONS

Krone, "Krone airES Technology" brochure, 6 pages, 2003.

*Primary Examiner* — Donghai D Nguyen

(74) *Attorney, Agent, or Firm* — Christopher S. Clancy; Christopher K. Marlow

(57) ABSTRACT

A cable and method of forming the cable are presented. The cable contains twisted wire pairs disposed in a cavity defined by a jacket. Each wire has a conductor and an insulator surrounding the conductor. The cable may also contain a spline that separates the twisted wire pairs. At least one of the insulators or the jacket is helically corrugated such that ridges extend radially inward or outward. The ridges of the insulators may be the same or different. The cable is extruded from an extruder. The jacket may contain corrugations after being extruded by the extruder. The cable may be passed through dies to form a helically corrugated jacket. The jacket heated by a heater prior to being passed through the dies, or may pass through the dies while still hot from the extruder.

4 Claims, 7 Drawing Sheets

(51) Int. Cl.
*H01B 13/14* (2006.01)
*H01B 11/00* (2006.01)

(56) References Cited

U.S. PATENT DOCUMENTS

| | | | | |
|---|---|---|---|---|
| 1,993,526 | A | 3/1935 | Rihl | |
| 2,048,811 | A | 7/1936 | Peirce | |
| 2,583,025 | A | 1/1952 | Swift et al. | |
| 2,583,026 | A | 1/1952 | Swift | |
| 2,956,311 | A | 10/1960 | Raydt et al. | |
| 3,086,557 | A | 4/1963 | Peterson | |
| 3,349,156 | A | 10/1967 | Zieg | |
| 3,435,105 | A | 3/1969 | Ferrari | |
| 3,538,209 | A | 11/1970 | Hegler | |
| 3,650,862 | A | 3/1972 | Burr | |
| 3,692,889 | A | 9/1972 | Hetrich | |
| 3,705,779 | A | 12/1972 | Zon | |
| 3,776,679 | A | 12/1973 | Hegler | |
| 3,928,519 | A | 12/1975 | Kashiyama et al. | |
| 3,959,427 | A | 12/1975 | Van Zon | |
| 3,996,323 | A | 12/1976 | Hegler et al. | |
| 4,011,118 | A | 3/1977 | Geominy | |
| 4,317,955 | A | 3/1982 | Choi | |
| 4,394,705 | A | 7/1983 | Blachman | |
| 4,555,230 | A | 11/1985 | Lupke | |
| 4,731,138 | A | 3/1988 | Lupke | |
| 4,853,516 | A | 8/1989 | Julien et al. | |
| 4,866,212 | A | 9/1989 | Ingram | |
| 4,892,442 | A | 1/1990 | Shoffner | |
| 4,953,946 | A | 9/1990 | Huybrechts | |
| 5,077,449 | A | 12/1991 | Cornibert et al. | |
| 5,286,923 | A | 2/1994 | Prudhon et al. | |
| 5,330,600 | A | 7/1994 | Lupke | |
| 5,383,998 | A | 1/1995 | Lupke | |
| 5,442,131 | A | 8/1995 | Bogwarth | |
| 5,544,270 | A | 8/1996 | Clark et al. | |
| 5,563,376 | A | 10/1996 | Hansell, III et al. | |
| 5,574,250 | A | 11/1996 | Hardie et al. | |
| 5,606,151 | A | 2/1997 | Siekierka et al. | |
| 5,696,352 | A | 12/1997 | Kourimsky | |
| 5,777,260 | A | 7/1998 | Klumps et al. | |
| 5,796,046 | A | 8/1998 | Newmoyer et al. | |
| 5,827,468 | A | 10/1998 | Jenewein | |
| 5,922,155 | A | 7/1999 | Clouet et al. | |
| 5,969,295 | A | 10/1999 | Boucino et al. | |
| 5,985,448 | A | 11/1999 | Koenig | |
| 5,990,419 | A | 11/1999 | Bogese, II | |
| 6,074,503 | A | 6/2000 | Clark et al. | |
| 6,194,663 | B1 | 2/2001 | Friesen et al. | |
| 6,248,954 | B1 * | 6/2001 | Clark et al. | 174/113 R |
| 6,303,867 | B1 | 10/2001 | Clark et al. | |
| 6,452,105 | B2 | 9/2002 | Badii et al. | |
| 6,465,737 | B1 | 10/2002 | Bonato et al. | |
| 6,476,326 | B1 | 11/2002 | Fuzier et al. | |
| 6,506,976 | B1 | 1/2003 | Neveux, Jr. | |
| 6,534,715 | B1 * | 3/2003 | Maunder et al. | 174/110 R |
| 6,541,708 | B2 | 4/2003 | Suehiro | |
| 6,570,095 | B2 | 5/2003 | Clark et al. | |
| 6,573,456 | B2 | 6/2003 | Spruell et al. | |
| 6,596,944 | B1 | 7/2003 | Clark et al. | |
| 6,639,152 | B2 | 10/2003 | Glew et al. | |
| 6,686,537 | B1 | 2/2004 | Gareis et al. | |
| 6,743,983 | B2 | 6/2004 | Wiekhorst et al. | |
| 6,787,694 | B1 | 9/2004 | Vexler et al. | |
| 6,787,697 | B2 | 9/2004 | Stipes et al. | |
| 6,800,811 | B1 | 10/2004 | Boucino | |
| 6,812,408 | B2 | 11/2004 | Clark et al. | |
| 6,815,611 | B1 | 11/2004 | Gareis | |
| 6,815,617 | B1 | 11/2004 | Gebs et al. | |
| 6,825,418 | B1 | 11/2004 | Dollins et al. | |
| 6,855,889 | B2 | 2/2005 | Gareis | |
| 7,098,405 | B2 * | 8/2006 | Glew | 174/113 C |
| 7,511,225 | B2 * | 3/2009 | Wiekhorst et al. | 174/113 R |
| 2002/0079126 | A1 | 6/2002 | Valenzuela | |
| 2003/0205402 | A1 | 11/2003 | Koyasu et al. | |
| 2004/0055779 | A1 | 3/2004 | Wiekhorst et al. | |
| 2004/0055781 | A1 | 3/2004 | Cornibert et al. | |
| 2004/0062496 | A1 | 4/2004 | Shuman et al. | |
| 2004/0149484 | A1 | 8/2004 | Clark | |
| 2004/0216914 | A1 | 11/2004 | Vexler et al. | |
| 2004/0256139 | A1 | 12/2004 | Clark | |
| 2005/0006132 | A1 | 1/2005 | Clark | |
| 2005/0056454 | A1 | 3/2005 | Clark | |
| 2005/0189135 | A1 | 9/2005 | Clark | |
| 2005/0230145 | A1 | 10/2005 | Ishii et al. | |

FOREIGN PATENT DOCUMENTS

| | | |
|---|---|---|
| JP | 10310069 | 11/1998 |
| WO | 9320564 A1 | 10/1993 |

* cited by examiner

METHOD FOR FORMING AN ENHANCED COMMUNICATION CABLE

CROSS-REFERENCE TO RELATED APPLICATIONS

This application is a continuation of U.S. application Ser. No. 11/735,132, filed Apr. 13, 2007, which issued as U.S. Pat. No. 7,946,031, which is a continuation of U.S. application Ser. No. 11/353,885, filed on Feb. 14, 2006, which issued as U.S. Pat. No. 7,205,479 on Apr. 17, 2007, which claims priority to U.S. Provisional Application No. 60/653,286, filed Feb. 14, 2005. The above applications are hereby incorporated by reference in their entireties.

FIELD OF THE INVENTION

The present invention relates generally to communications cables and more specifically relates to apparatus and methods for reducing alien crosstalk between communications cables.

BACKGROUND OF THE INVENTION

Suppression of alien crosstalk in communication systems is an increasingly important practice for improving systems' reliability and the quality of communication. As the bandwidth of a communication systems increases, so does the importance of reducing or eliminating alien crosstalk.

In wired communication systems, crosstalk is caused by electromagnetic interference within a communication cable or between cables. Crosstalk resulting from interaction between cables is known as alien crosstalk. Alien near-end crosstalk (alien NEXT) occurs when signals transmitted on one cable disturb signals in another cable. Alien NEXT travels in the disturbed cable in the direction opposite the direction of signal travel in the disturbing cable. As communications signal frequencies and data transmission rates increase, alien NEXT becomes problematic and is a barrier to increased signal frequencies and data transmission rates. Alien crosstalk degrades or destroys performance, for example, in 10 Gbps Ethernet communications over installed cable such as Cat 5e, Cat 6, or Cat 6e cable.

The magnitude of alien crosstalk increases with increased capacitance between nearby cables. Thus, alien crosstalk can be decreased by decreasing this capacitance. Capacitance, in turn, may be decreased in two ways: by increasing the distance between cables, and by decreasing the effective dielectric constant of the material between the two cables. Because there are physical barriers to increasing the distance between two cables—including cable size considerations—it is desirable to space cables (or conductors within a cable) at an acceptable distance from each other while minimizing the effective dielectric constant of the material between cables.

Air is the most effective low-dielectric-constant material, but other materials must be placed between cables to provide insulation and physical separation. The present invention is directed to structures and methods that decrease the effective dielectric constant between cables while maintaining a desirable physical separation between the cables. Structures and methods according to some embodiments of the present invention may be applied to previously installed cabling.

SUMMARY OF THE INVENTION

According to one embodiment of the present invention, insulation is provided along cables to decrease alien crosstalk between cables.

According to some embodiments of the present invention, a communication cable jacket is provided to increase the physical separation between adjacent cables while maintaining low capacitance between the cables.

According to some embodiments of the present invention, a cable jacket is helically corrugated to provide air space and physical separation between adjacent cables.

Cables may be newly manufactured with jacket structures according to the present invention.

DETAILED DESCRIPTION OF THE ILLUSTRATED EMBODIMENTS

Figure 1:
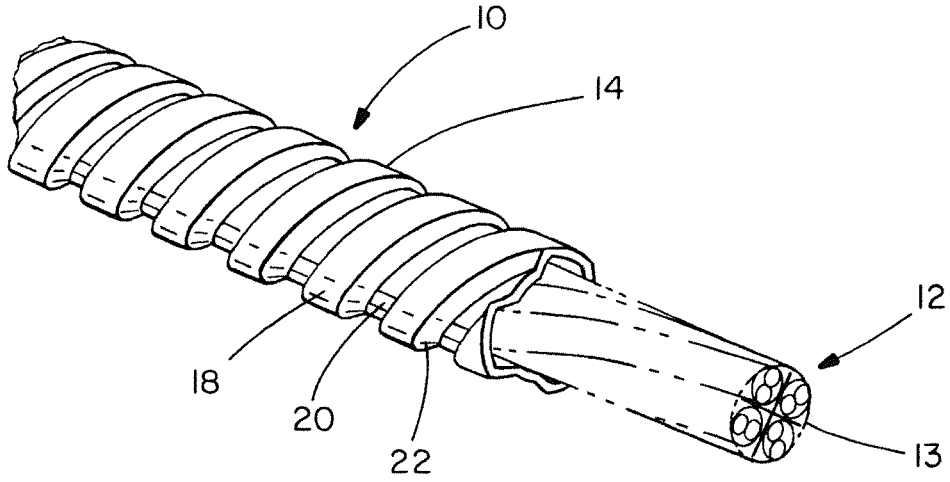
FIG. 1 is a perspective view of a helically corrugated data cable jacket.

Turning now to FIG. 1, a data cable 10 is shown. The data cable 10 comprises twisted wire pairs 12 with a helically corrugated tube 14 overlaid around the twisted wire pairs 12.

In one embodiment of the present invention, a data cable is manufactured with the helically corrugated tube 14 surrounding the twisted wire pairs 12. In this case, the helically corrugated tube 14 is the jacket of the data cable 10. The twisted wire pairs 12 are separated by a spline 13.

The helically corrugated jacket 14 is provided with ridges 18 and depressions 20. Side walls 22 join the ridges 18 to the depressions 20 and may be provided at an angle, as more clearly shown in FIG. 3. The use of angled side walls 22 allows for easier removal of the helically corrugated jacket 14 from mold blocks in some methods of manufacture of the jacket. One method for manufacturing jackets according to the present invention is the vacuum molding of a jacket using a continuous vacuum molding and corrugating machine.

Figure 2:
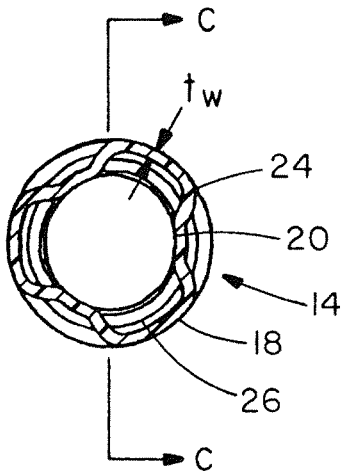
FIG. 2 is an end view of a helically corrugated jacket according to one embodiment of the present invention.

As more clearly seen in the end view shown in FIG. 2, according to one embodiment of the present invention, the helically corrugated jacket 14 comprises a corrugated wall 24 having a substantially uniform thickness, $t_w$. The alternating ridges 18 and depressions 20 form gaps 26 between the helically corrugated jacket 14 and the twisted wire pairs 12. According to one embodiment of the present invention, the gaps 26 remain filled with air, so that the use of the helically corrugated jacket 14 increases the minimum physical separation between adjacent cables along the cable path. This embodiment also maintains a low effective dielectric constant for the material between adjacent cables by increasing the effective air space between adjacent cables. In the embodiment shown in FIGS. 1-3, three helices are provided along the helically corrugated jacket 14, but more or fewer helices may be provided in alternative embodiments.

Figure 3:
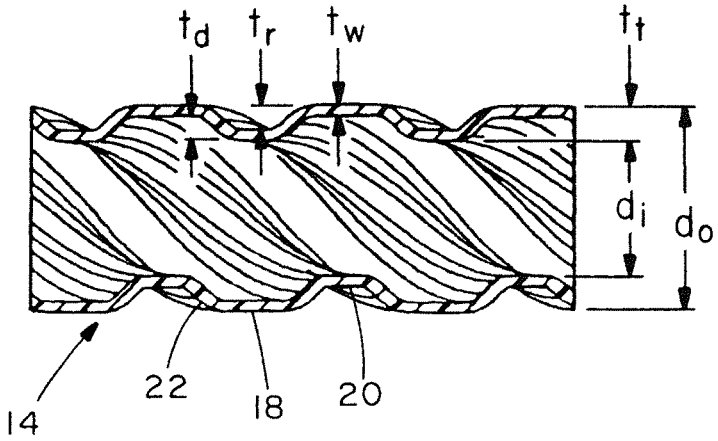
FIG. 3 is a side cross-sectional view of the helically corrugated jacket of FIG. 2 along the line C-C of FIG. 2.

Turning to FIG. 3, a cross-sectional view of the helically corrugated jacket 14 taken along the line C-C of FIG. 2 is shown. The helically corrugated jacket 14 has an outer diameter, $d_o$, formed by the outer edges of the ridges 18 and an inner diameter, $d_i$ formed by the inner edges of the depressions 20. The thickness $t_w$ of the corrugated wall 24 can also be seen in FIG. 3.

Helically corrugated jackets according to the present invention may be manufactured of a variety of materials and with a variety of dimensions. For example, for use in standard (non-plenum) deployments, jackets may be manufactured of flame retardant polyethylene. For deployments in air ducts, jackets may be manufactured of plenum-grade PVC.

The dimensions of helically corrugated jackets according to the present invention are preferably selected to increase air space between adjacent cables, decrease the amount of material used in the construction of the helically corrugated jackets, and still maintain acceptable inner and outer diameters ($d_i$ and $d_o$) for the helically corrugated jacket 14.

Referring again to FIG. 3, a number of dimensions of the helically corrugated jacket 14 can be selected to result in desired tube size and net dielectric characteristics. The shown dimensions are as follows:

$t_w$=Thickness of the corrugated wall 24

$t_r$=Thickness of the helically corrugated jacket 14 from the inner surface of the depressions 20 to the outer surface of the ridges 18

$t_r$=Thickness from the outer surface of a depression 20 to the outer surface of a ridge 18

$t_d$=Thickness from the inner surface of a depression 20 to the inner surface of a ridge 18

$d_o$=Outside diameter of the helically corrugated jacket 14

$d_i$=Inside diameter of the helically corrugated jacket 14

Figure 4:
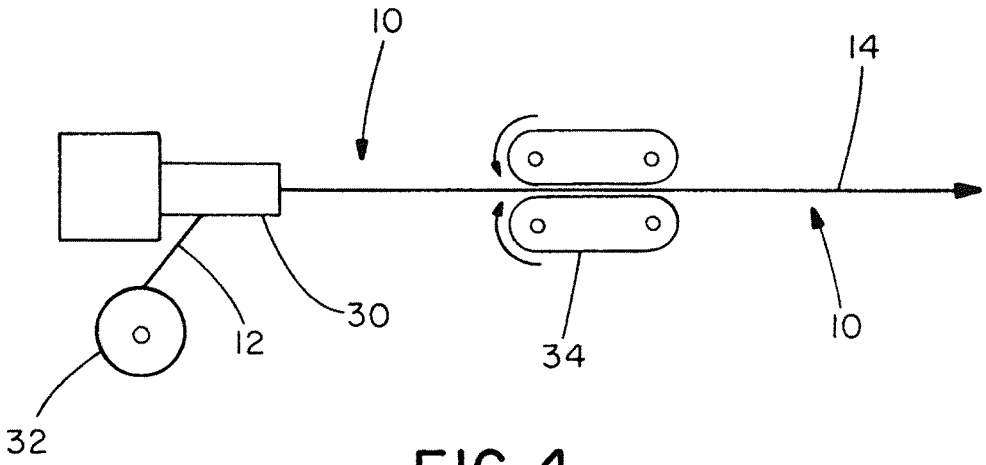
FIG. 4 is a schematic of the manufacture of a cable according to one embodiment of the present invention.

Turning now to FIG. 4, one method of manufacturing the helically corrugated jacket 14 over the twisted wire pairs 12 will be described. In this embodiment, an extruder 30 is provided. The twisted wire pairs 12 are stored on a spool 32 and fed into the extruder 30, and the jacket is over-extruded. The still-hot jacketed cable 10 passes through a set of matched tractor drive vacuum-forming dies 34. The dies 34 vacuum-form the helically corrugated jacket 14 into the desired spiral-convoluted shape.

The finished jacket 14 is, geometrically, partially air and has a reduced volume of jacket material, which reduces the effective dielectric. This also spaces adjacent cables further from each other, reducing alien cross-talk.

Figure 5:
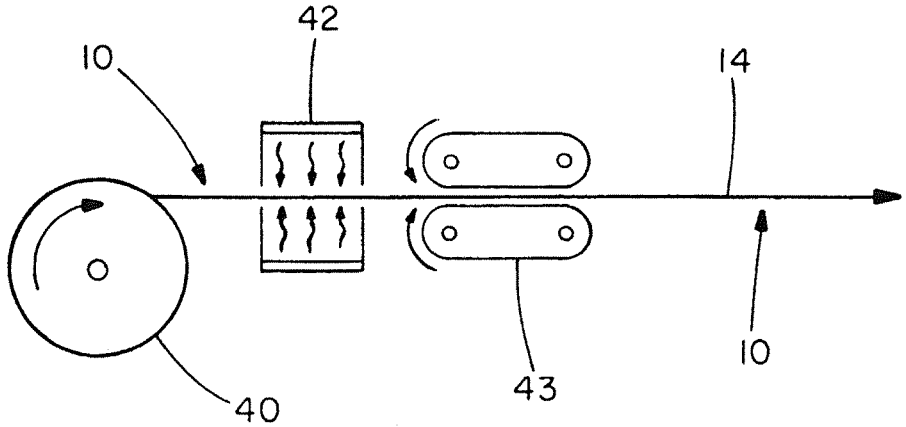
FIG. 5 is a schematic of the manufacture of a cable according to another embodiment of the present invention.

FIG. 5 illustrates another method of manufacturing the helically corrugated jacket 14 over the twisted wire pairs 12. In this embodiment, the completed cable 10, including the jacket (non-corrugated) and the twisted wire pairs 12, are stored on a spool 40. The cold cable is heated by heaters 42 and then passed through vacuum-forming dies 43. As in the embodiment described above, the vacuum-forming dies 43 vacuum-form the jacket 14 into the desired spiral-convoluted shape. The spiral-convoluted jacket 14 improves the overall cable performance as described above.

Figure 6:
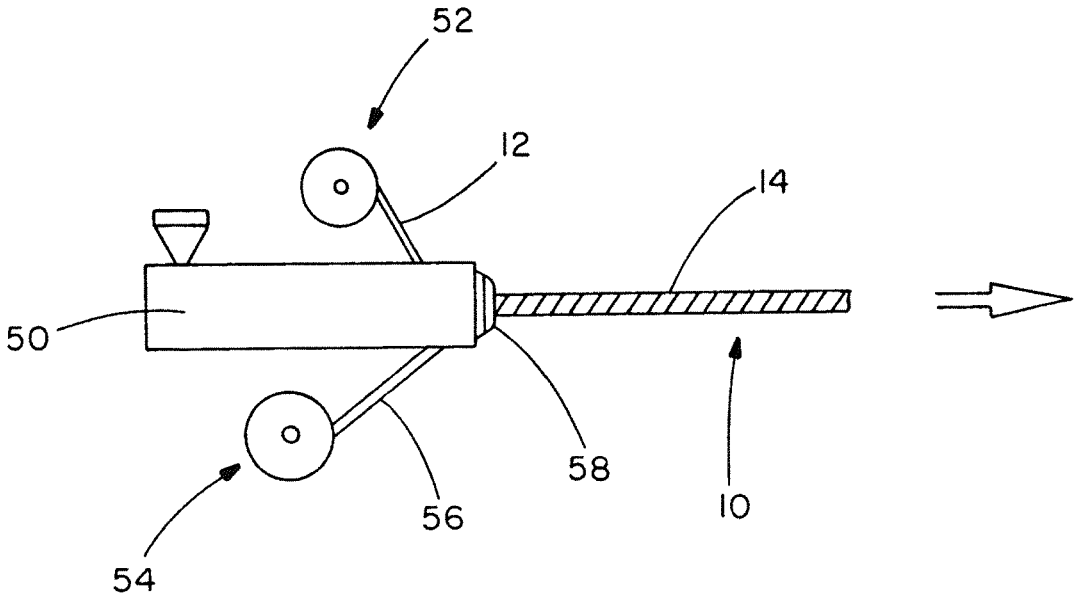
FIG. 6 is a schematic of the manufacture of a cable according to another embodiment of the present invention.
Figure 7A:
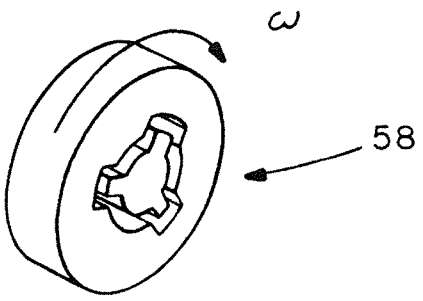
FIG. 7*a* is a perspective view of a rotating die of FIG. 6 for the corrugated cable jacket of FIG. 1.
Figure 7B:
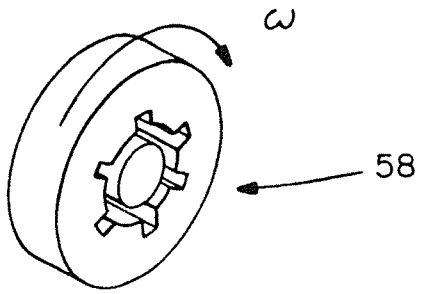
FIG. 7*b* is a perspective view of a rotating die of FIG. 6 for the corrugated cable jacket of FIG. 8*a;*
Figure 7C:
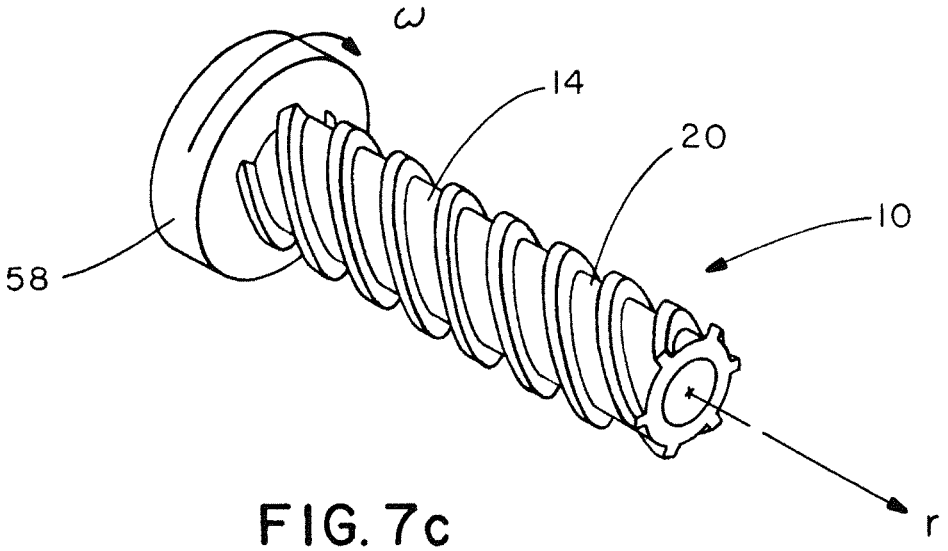
FIG. 7*c* is a perspective view of a rotating die of FIG. 6 and the corrugated cable jacket of FIG. 8*a* as the jacket is extruded.

Turning now to FIG. 6, an additional method of manufacturing the cable 10 will be described. In this embodiment, an extruder 50 is provided. The twisted wire pairs 12 are stored on a spool 52 and fed into the extruder 50. Stored on a second spool 54 is a spline 56 (shown in more detail in FIGS. 8*a* and 8*b*) that is also fed into the extruder 50. As shown in FIGS. 7*a*, 7*b*, and 7*c*, a rotating die 58 is located at the end of the extruder 50. The die is rotated at an angular velocity ω and the cable 10 is extruded at a linear velocity ν in the direction indicated. The rotation of the die 58 during the extrusion process yields a spiral jacket 14 for the cable 10. By varying the angular velocity ω and the extrusion velocity ν, the pitch of the depressions 20 can be varied.

Figure 8A:
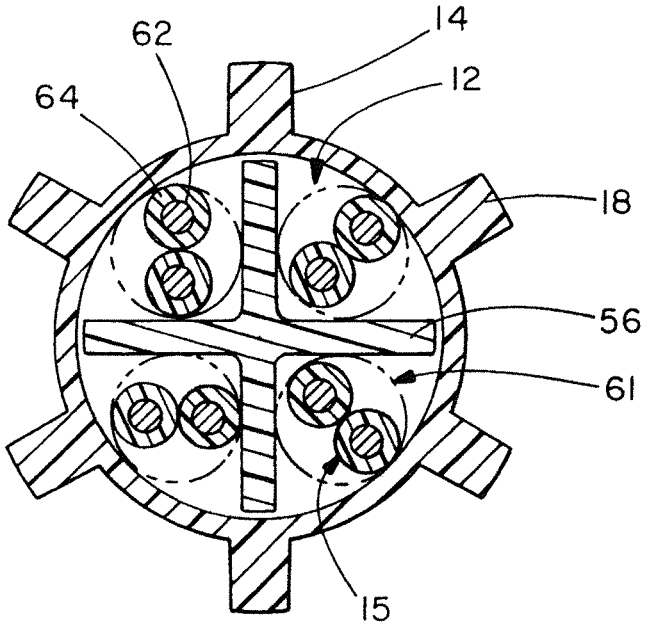
FIG. 8*a* is a cross-sectional end view of a cable according to one embodiment of the present invention.

A cross-section of one embodiment of a data cable is illustrated in FIG. 8*a*. The data cable includes four twisted wire pairs 12. Each twisted wire pair 12 has an outer diameter indicated at 61. Each of the wires 15 includes an inner conductor 62 and an insulation 64. The four twisted wire pairs 12 are separated by the spline 56. As shown in this embodiment, the spiral ridges 18 are on the outside of the jacket 14.

Figure 8B:
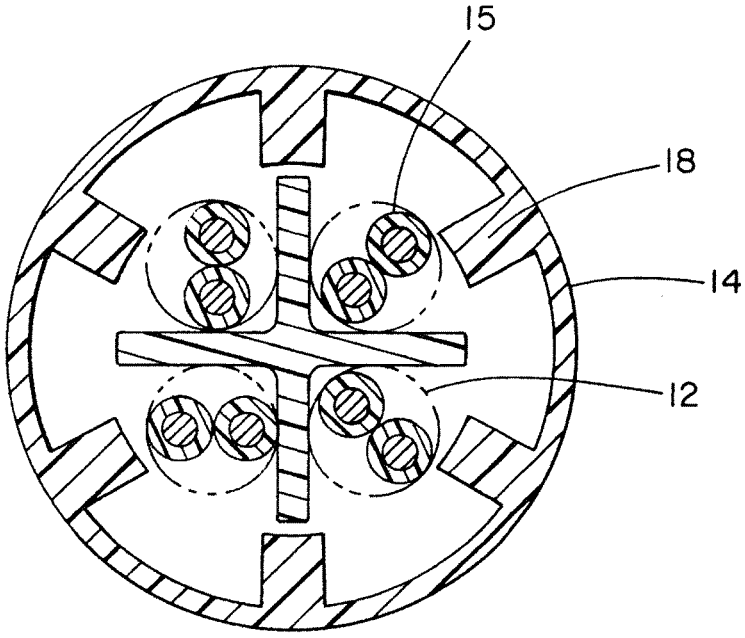
FIG. 8*b* is a cross-sectional end view of a cable according to another embodiment of the present invention.
Figure 8C:
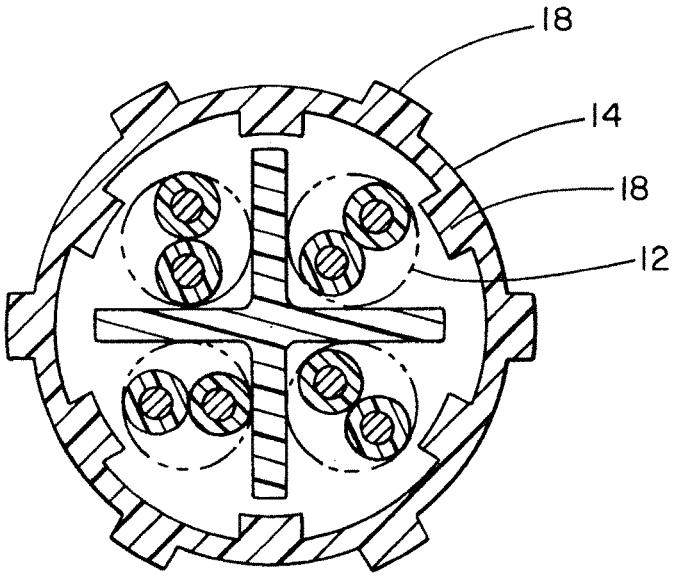
FIG. 8*c* is a cross-sectional end view of a cable according to another embodiment of the present invention.
Figure 8D:
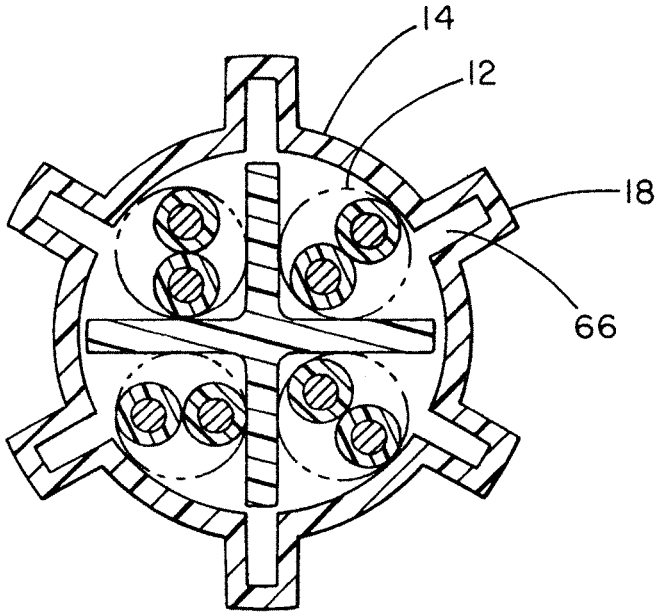
FIG. 8*d* is a cross-sectional end view of a cable according to yet another embodiment of the present invention.

In the embodiment shown in FIG. 8*b*, the spiral ridges 18 are on the inside of the jacket 14. The spiral ridges 18 are on both the inside and the outside of the jacket 14 in the data cable shown in FIG. 8*c*. FIG. 8*d* illustrates a cored or thin-walled spiral jacket 14. In this embodiment, the ridges 18 include gaps 66.

Figure 9:
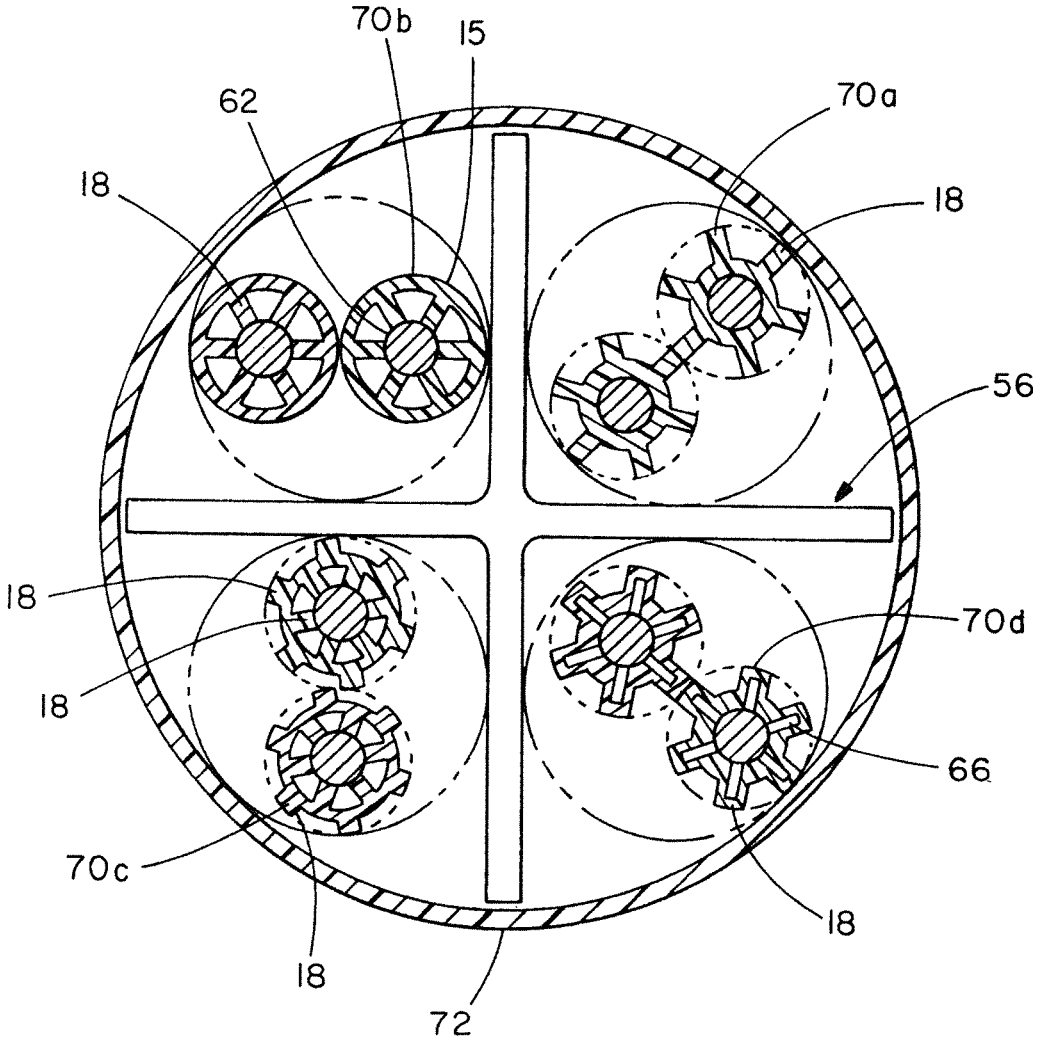
FIG. 9 is a cross-sectional end view of a cable illustrating various insulation cross-sections for twisted pairs within a cable.

Turning now to FIG. 9, another embodiment of the present invention will be described. Each of the wires 15 includes a spiraled outer covering 70*a-d*. The wires 15 each include the inner conductor 62. The spiral outer coverings 70*a-d* can be manufactured using methods similar to those described above in conjunction with FIGS. 4-7. As shown in FIG. 9, each of the wires of the twisted pairs 12 has a different pattern of ridges 18. However, in use, all wires may include the same pattern of ridges 18. In other embodiments having spiraled coverings over the wires, the outer jacket 72 may also be corrugated.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention.

The invention claimed is:

1. A method of forming a cable, the method comprising:

feeding twisted wire pairs into an extruder, each wire of the twisted wire pairs including a conductor and an insulator surrounding the conductor;

feeding a spline into the extruder;

combining the spline and twisted wire pairs in the extruder;

extruding a jacketed cable from the extruder, the jacketed cable containing the combination of the twisted wire pairs and spline disposed in a cavity defined by a spiral jacket, and at least one of the insulators is corrugated such that the cored ridges are adjacent to the conductor and extend outwardly from a surface of the conductor to form an air gap that extends from the conductor; and varying a rotation rate of a die located at an end of the extruder and an extrusion velocity of the jacketed cable to vary a pitch of depressions of the spiral jacket.

2. The method of claim 1 wherein the spiral jacket is corrugated such that the cored ridges extend outwardly from a central axis of the cable to form an air gap that extends from the cavity.

3. The method of claim 2 wherein the spiral jacket and the at least one of the insulators have different types of corrugations.

4. The method of claim 1 wherein at of he insulators have different types of corrugations.

* * * * *